US008463173B2

(12) United States Patent
Okano

(10) Patent No.: US 8,463,173 B2
(45) Date of Patent: Jun. 11, 2013

(54) IMAGE FORMING APPARATUS

(75) Inventor: Tetsuya Okano, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 872 days.

(21) Appl. No.: 12/561,073

(22) Filed: Sep. 16, 2009

(65) Prior Publication Data

US 2010/0074640 A1 Mar. 25, 2010

(30) Foreign Application Priority Data

Sep. 24, 2008 (JP) ..... 2008-244445

(51) Int. Cl.

| | |
|---|---|
| ***G03G 15/00*** | (2006.01) |
| ***B65H 5/22*** | (2006.01) |
| ***B65H 83/00*** | (2006.01) |
| ***B65H 85/00*** | (2006.01) |
| ***B65H 39/10*** | (2006.01) |

(52) U.S. Cl.

USPC ..... 399/405; 399/389; 271/3.19; 271/302

(58) Field of Classification Search

USPC ..... 399/381, 389, 397, 405; 271/3.19, 271/278, 279, 289, 302

See application file for complete search history.

(56) References Cited

U.S. PATENT DOCUMENTS

| | | | | |
|---|---|---|---|---|
| 6,177,977 | B1 | 1/2001 | Tanaka et al. | |
| 7,024,124 | B2 | 4/2006 | Taguchi et al. | |
| 7,142,790 | B2 * | 11/2006 | Takahashi | 399/16 |
| 2007/0053731 | A1 * | 3/2007 | Mori et al. | 399/341 |

FOREIGN PATENT DOCUMENTS

| | | | |
|---|---|---|---|
| JP | H02-132056 | A | 5/1990 |
| JP | H05-017047 | A | 1/1993 |
| JP | H08-166746 | A | 6/1996 |
| JP | 10035981 | A * | 2/1998 |
| JP | H10-035981 | A | 2/1998 |
| JP | 2000-118790 | A | 4/2000 |
| JP | 2000-191244 | A | 7/2000 |
| JP | 2002-326749 | A | 11/2002 |
| JP | 2004-212466 | A | 7/2004 |
| JP | 2004-219680 | A | 8/2004 |
| JP | 2005-055817 | A | 3/2005 |

OTHER PUBLICATIONS

Japan Patent Office; Notification of Reason for Refusal for Patent Application No. 2008-244445, dated Sep. 28, 2010. (counterpart to above-captioned U.S. patent application).

* cited by examiner

*Primary Examiner* — Judy Nguyen
*Assistant Examiner* — Justin Olamit
(74) *Attorney, Agent, or Firm* — Baker Botts L.L.P.

(57) ABSTRACT

An image forming apparatus includes: an image forming unit; a first sheet discharging path having a first dischargeable minimum sheet length; a second sheet discharging path having a second dischargeable minimum sheet length that is shorter than the first dischargeable minimum sheet length; a measuring unit that measures a length of the sheet; and a control unit. When the length of the sheet is shorter than the first dischargeable minimum sheet length in a state in which the first sheet discharging path is selected, the control unit is configured to: control the image forming unit to form the image on the measured sheet; convey the measured sheet downstream in a sheet conveying direction from the image forming unit; and stop conveyance of a sheet subsequent to the measured sheet at a position upstream in the sheet conveying direction from the measured sheet.

6 Claims, 12 Drawing Sheets

FIG. 12

41

OCCURRENCE OF SHEET REMAINING UNDELIVERED

SHEET REMAINS UNDELIVERED IN THE APPARATUS.

THERE IS A POSSIBILITY THAT SHEET OF SIZE THAT CANNOT BE DISCHARGED TO THE SHEET DISCHARGE TRAY MAY BE CONVEYED.

---

PLEASE OPEN THE REAR COVER.

IMAGE FORMING APPARATUS

This application claims priority from Japanese Patent Application No. 2008-244445 filed on Sep. 24, 2008, the entire subject matter of which is incorporated herein by reference.

TECHNICAL FIELD

The invention relates to an image forming apparatus including a plurality of sheet discharging paths. More particularly, the invention relates to an image forming apparatus, in which one minimum sheet length of a sheet that can be discharged on one sheet discharging path is shorter than another minimum sheet length of a sheet that can be discharged on another sheet discharging path.

BACKGROUND

A known image forming apparatus includes at least two types of sheet discharging paths. As the known image forming apparatus, a printer including a sheet discharging path shaped like a U-turn (i.e., U-turn path) and a straight sheet discharging path (i.e., straight path), for example, has been proposed.

The printer as the known image forming apparatus having two types of sheet discharging paths enables a user to use one of the sheet discharging paths selectively. For example, the printer switches the sheet discharging path to the U-turn path for face down printing or to the straight path for forming an image onto a firm sheet such as a cardboard.

SUMMARY

Illustrative aspects of the invention provide an image forming apparatus that is capable of suppressing an occurrence of a jam when a sheet having a sheet length shorter than a minimum sheet length that is dischargeable on a selected sheet discharging path.

BRIEF DESCRIPTION OF THE DRAWINGS

Illustrative aspects of the invention will be described in detail with reference to the following figures wherein:

FIG. 12 is a drawing showing an example of a display unit notifying that the sheet remains undelivered.

DETAILED DESCRIPTION

General Overview

Figure 1:
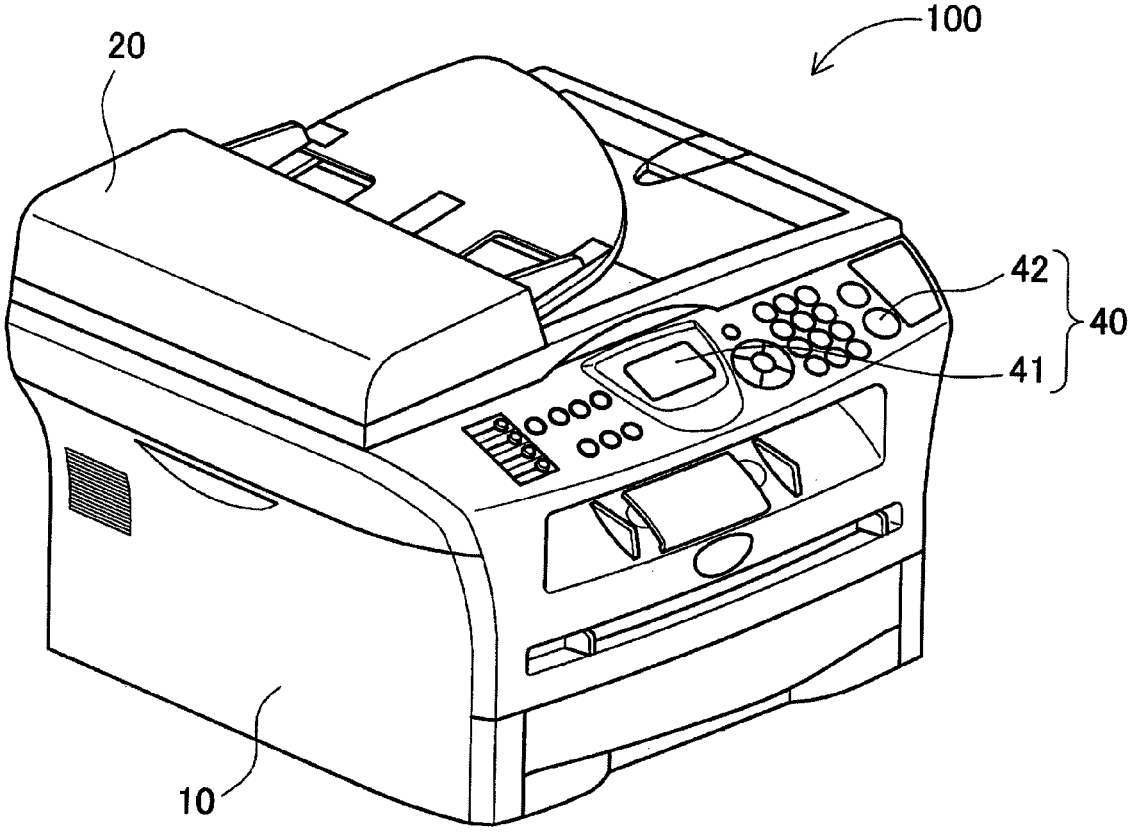
FIG. 1 is a schematic perspective view of an image forming apparatus according to an exemplary embodiment of the invention.

In the known image forming apparatus including a plurality of conveying paths, the minimum sheet length of a sheet may vary from one conveying path to another conveying path. In this case, although a sheet having a longer sheet length than the minimum sheet length of a sheet that can be printed as the image forming apparatus is conveyed, a jam may occur.

For example, if the minimum roller spacing in the U-turn path is wider than the minimum roller spacing in the straight path, minimum sheet length L1 of a sheet that can be discharged on the U-turn path becomes longer than minimum sheet length L2 of a sheet that can be discharged on the straight path. In the configuration, the minimum sheet length of a sheet that can be printed as the image forming apparatus becomes L2. However, if a sheet having the sheet length L2 is conveyed to the U-turn path, the sheet is not discharged and remains undelivered in the U-turn path.

In this state, if an attempt is made to consecutively convey a subsequent sheet to the U-turn path, the sheet remaining undelivered hinders conveying the subsequent sheet, resulting in occurrence of a jam. The user may be confused by the occurrence of the jam even though the sheet has the minimum sheet length L2 of a sheet that can be printed as the image forming apparatus or a longer length.

Therefore, illustrative aspects of the invention provide an image forming apparatus that is capable of suppressing an occurrence of a jam when a sheet having a sheet length shorter than a minimum sheet length that is dischargeable on a selected sheet discharging path.

According to a first illustrative aspect of the invention, there is provided an image forming apparatus comprising: an image forming unit that forms an image on a sheet; a first sheet discharging path, which discharges a sheet passed through the image forming unit, and which has a first dischargeable minimum sheet length; a second sheet discharging path, which discharges the sheet passed through the image forming unit, and which has a second dischargeable minimum sheet length, the second dischargeable minimum sheet length being shorter than the first dischargeable minimum sheet length; a measuring unit that measures a length of the sheet conveyed to the image forming unit; and a control unit, wherein, when the length of the sheet measured by the measuring unit is shorter than the first dischargeable minimum sheet length in a state in which the first sheet discharging path is selected, the control unit is configured to: control the image forming unit to form the image on the measured sheet; convey the measured sheet downstream in a sheet conveying direction from the image forming unit; and stop conveyance of a sheet subsequent to the measured sheet at a position upstream in the sheet conveying direction from the measured sheet.

The image forming apparatus of the invention includes the first sheet discharging path downstream from the image forming unit and the second sheet discharging path. The minimum sheet length of a dischargeable sheet on the second sheet discharging path (i.e., the second dischargeable minimum sheet length) is shorter than the minimum sheet length of a dischargeable sheet on the first sheet discharging path (i.e., the first dischargeable minimum sheet length). The second sheet discharging path branches from the first sheet discharging path and is provided by opening the cover for closing a part of the first sheet discharging path. The image forming unit includes not only an image forming unit for forming an image, but also a fixing unit for fixing an image on a sheet if the image forming apparatus is an electrophotographic image forming apparatus, for example. When a sheet is conveyed to the first sheet discharging path, if the length of the sheet is shorter than the minimum sheet length of a sheet that can be conveyed on the first sheet discharging path, the image forming apparatus forms an image on the sheet, conveys the sheet downstream from the image forming unit, and stops conveyance of the sheet subsequent to that sheet (subsequent sheet) upstream from the sheet.

That is, in the image forming apparatus according the invention, if the sheet which may remain undelivered in the first sheet discharging path is conveyed, the sheet is conveyed downstream from the image forming unit. Thus, the sheet remains undelivered in the first sheet discharging path in a printed state. Further, the subsequent sheet is stopped upstream from the sheet. Accordingly, a serious jam that can occur as the sheet remaining undelivered and the subsequent sheet comes in contact with each other can be avoided. Therefore, damage caused as the sheet remaining undelivered comes in contact with the subsequent sheet can be avoided.

According to a second illustrative aspect of the invention, in the image forming apparatus, wherein the image forming unit comprises a fixing unit that fixes the image on the sheet, and wherein the control unit stops the subsequent sheet at upstream from the fixing unit.

That is, if a user removes the sheet from the fixing unit, the fixing unit may get dirty by unfixed developer, and thus the subsequent sheets conveyed to the fixing unit may become dirty. Further, a complicated work procedure may be required to remove the sheet from the fixing unit. These problems will be solved by stopping the subsequent sheet before the sheet arrives at the fixing unit.

According to a third illustrative aspect of the invention, the image forming apparatus further comprises: a conveying roller that adjusts a timing of conveying the sheet to the image forming unit; and a sensor, which detects a passage of the sheet, and which is positioned upstream in the sheet conveying direction from the image forming unit and downstream from the conveying roller, wherein the measuring unit measures the length of the sheet based on a detection result of the sensor.

Usually, the sensor for detecting the sheet arrival timing at the image forming unit is accurate. By using such an accurate sensor to measure the sheet length, the control of the control unit becomes more accurate.

According to a fourth illustrative aspect of the invention, the image forming apparatus further comprises: a feed roller that feeds the sheet; a second sensor, which detects the passage of the sheet, and which is positioned upstream in the sheet conveying direction from the conveying roller and downstream from the feed roller; and a second measuring unit that measures the sheet length with using the second sensor, wherein, when the length of the sheet measured by the second measuring unit is shorter than the first dischargeable minimum sheet length, the control unit suspends the conveyance of the subsequent sheet at least until the measuring unit completes the measurement of the sheet.

That is, the sheet length is measured at an early stage by using the second sensor positioned closer the feed roller from the sensor. If the sheet is suspected of remaining undelivered, the subsequent sheet is made to wait. Accordingly, it is possible to prevent a situation where a plurality of sheets are stopped in the conveying path.

Herein, according to a fifth illustrative aspect of the invention, the second sensor is positioned upstream in the sheet conveying direction from the sensor.

According to a sixth illustrative aspect of the invention, in the image forming apparatus, wherein, after the conveyance of the subsequent sheet is suspended as a result of the measurement by the second measuring unit, the control unit restarts the conveyance of the subsequent sheet when the length of the sheet is longer than the first dischargeable minimum sheet length as a result of the measurement by the measuring unit.

That is, the second sensor generally has lower accuracy than the sensor described above. Thus, the determination of the second sensor may be overturned by the determination of the sensor described above. In such a case, by giving higher priority to the determination in the sensor described above than the determination in the second sensor, sheet can be conveyed more precisely.

According to a seventh illustrative aspect of the invention, the image forming apparatus further comprises: a notification unit that notifies a user to switch the sheet conveying path from the first sheet discharging path to the second sheet discharging path when the length of the sheet is shorter than the first dischargeable minimum sheet length.

That is, by notifying the user to switch the sheet discharging path, the conveyance of the sheet will be early restarted.

According to an eighth illustrative aspect of the invention, the image forming apparatus further comprises: a cover, which is openable and closeable with respect to the image forming unit, and which forms a part of the first sheet discharging path when the cover is in a closed state, wherein the first sheet discharging path forms a path for reversing a traveling direction of the sheet passed through the image forming unit, and wherein the second sheet discharging path, which is formed when the cover is in an open state, which is branched from the first sheet discharging path, and which discharges the sheet passed through the image forming unit without reversing the traveling direction thereof.

According to a ninth illustrative aspect of the invention, in the image forming apparatus, wherein the control unit determines that the first sheet discharging path is selected when the cover is in the closed state, and wherein the control unit determines that the second sheet discharging path is selected when the cover is in the open state.

According to a tenth illustrative aspect of the invention, there is provided an image forming apparatus comprising: an image forming unit that forms an image on a sheet; a fixing unit that fixes the image formed on the sheet to the sheet; a belt unit that conveys a sheet along the image forming unit to the fixing unit in a sheet conveying direction; a first sheet discharging path, which discharges a sheet passed through the image forming unit, and which has a first dischargeable minimum sheet length; a second sheet discharging path, which discharges the sheet passed through the image forming unit, and which has a second dischargeable minimum sheet length, the second dischargeable minimum sheet length being shorter than the first dischargeable minimum sheet length; a measuring unit that measures a length of the sheet conveyed to the image forming unit; and a control unit that is connected to the image forming unit, the fixing unit, the belt unit, the first sheet discharging path, the second sheet discharging path and a measuring unit; wherein, when the length of the sheet measured by the measuring unit is shorter than the first dischargeable minimum sheet length in a state in which the first sheet discharging path is selected, the control unit is configured to: control the image forming unit to form the image on the measured sheet; control the belt unit to convey the measured sheet downstream in the sheet conveying direction from the image forming unit; and control the belt unit to stop conveyance of a sheet subsequent to the measured sheet at a position upstream in the sheet conveying direction from the measured sheet.

Exemplary Embodiments

Exemplary embodiments of the invention will now be described with reference to the accompanying drawings.

(Image Forming Apparatus)

As shown in FIG. 1, an image forming apparatus 100 includes a main unit 10 for printing an image on a sheet and an image read unit 20 for reading an image of a document. An electrophotographic color printer, which includes a sheet discharging path for reversing the traveling direction of a sheet and discharging the sheet and a sheet discharging path for discharging the sheet without reversing the traveling direction thereof, is one example of the image forming apparatus 100. The image forming apparatus 100 further includes, on a front side of the image reading unit 20, an operation panel 40 including a display unit 41 made of a liquid crystal display and a button group 42 includes a start key, a stop key, a numeric keypad, etc. The operational panel 40 can display an operation state of the image forming apparatus. Further, a user can perform input operation through the operation panel 40.

(Main Unit)

Figure 2:
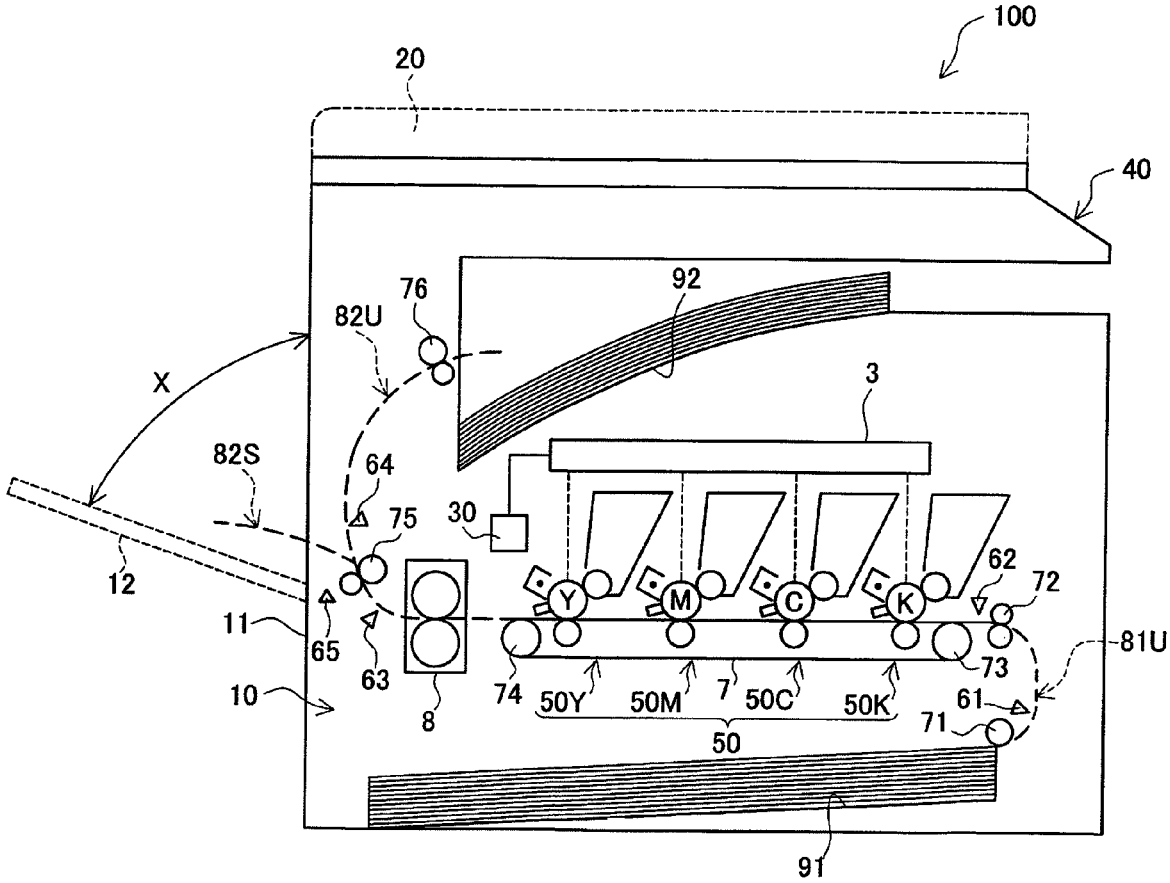
FIG. 2 is a schematic view of a main unit of the image forming apparatus.

As shown in FIG. 2, the main unit 10 includes a process unit 50 (one example of an image forming unit), a fixing unit 8 (one example of the image forming unit), a sheet feed cassette 91, a sheet discharge tray 92, an exposure unit 3 and a belt 7. The process unit 50 forms a developer image and transfers the developer image to a sheet. The fixing unit 8 fixes an unfixed developer image on the sheet. The sheet feed cassette 91 accommodates a sheet before image formation. The sheet discharge tray 92 places a sheet after the image formation thereon. A cover 12 is provided on a back face of a housing 11 that houses the main unit 10. The cover 12 rotates in a direction indicated by an arrow X in FIG. 2 so as to be openable and closable with respect to the housing 11.

The process unit 50 of the main unit 10 forms a color image. Process units corresponding to colors of yellow (Y), magenta (M), cyan (C), and black (K) are placed in parallel. The process unit 50 includes a process unit 50Y, 50M, 50C and 50K for forming to four colors (e.g., yellow, magenta, cyan and black). The exposure unit 3 emits light to the process units 50Y, 50M, 50C, and 50K. The belt 7 is stretched between rollers 73 and 74 so as to convey the sheet to transfer positions of the process units 50Y, 50M, 50C, and 50K. Incidentally, the belt 7 and the rollers 73 and 74 are one example of a belt unit.

Figure 3:
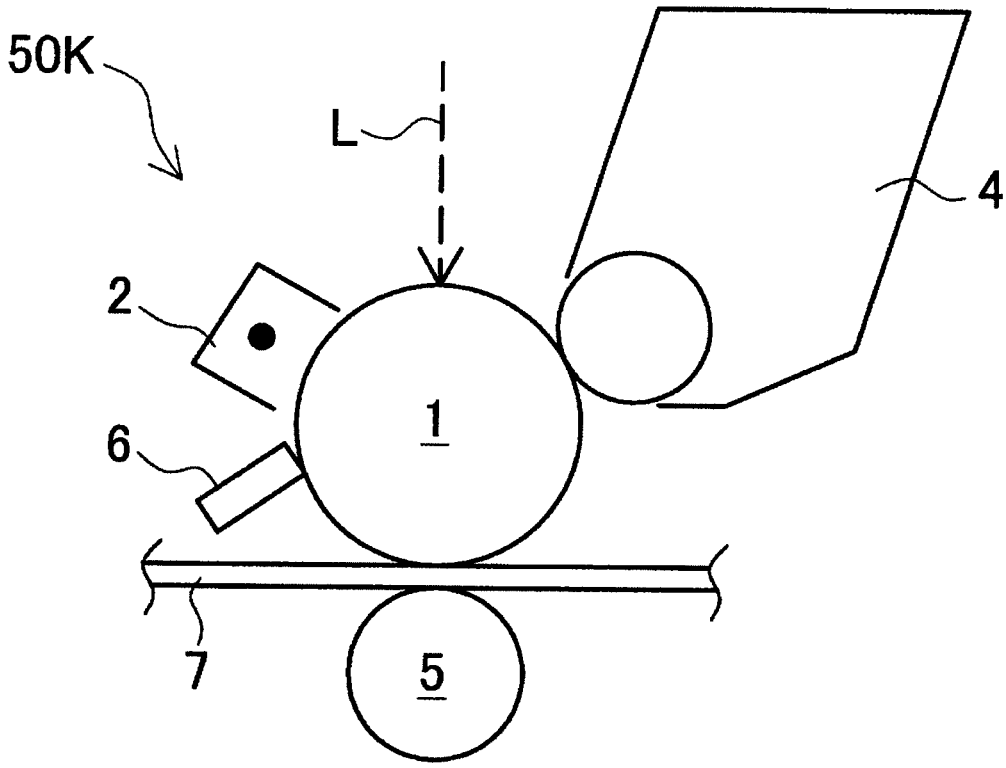
FIG. 3 is a schematic view of a process unit of the image forming apparatus.

The process unit 50K forms the developer image electrophotographically. As shown in FIG. 3, the process unit 50K includes a photosensitive drum 1, a charging unit 2 that uniformly charges a surface of the photosensitive drum 1, a developing unit 4 for developing an electrostatic latent image with developer, a transfer unit 5 for transferring the developer image on the photosensitive drum 1 to the sheet, and a cleaning blade 6 for removing the developer remained on the photosensitive drum 1. Incidentally, toner is one example of the developer. The photosensitive drum 1, the charging unit 2, the developing unit 4, and the cleaning blade 6 are formed as a process cartridge. The process cartridge is removably mounted to the main unit 10. Each of other process units 50Y, 50M, and 50C has a similar configuration to that of the process unit 50K.

In the process unit 50K, the surface of the photosensitive drum 1 is uniformly charged by the charging unit 2. Then, the photosensitive drum 1 is exposed to light L emitted from the exposure unit 3 to form an electrostatic latent image. Next, the developer is supplied to the photosensitive drum 1 through the developing unit 4. Accordingly, the electrostatic latent image on the photosensitive drum 1 is visualized as the developer image. The developer image is transferred to the sheet conveyed by the belt 7 at a position opposed to the transfer unit 5.

In the main unit 10, a sheet stored in the sheet feed cassette 91 positioned at the bottom is conveyed along a sheet feeding path 81U having a substantially U-shape, passes through a feed roller 71 and a registration roller 72, reverses a traveling direction thereof, and is introduced into the process unit 50. That is, in the main unit 10, sheets in the sheet feed cassette 91 are fed one at a time and the fed sheet is conveyed to the process unit 50 and the developer image is transferred to the sheet. Then, the sheet is conveyed to the fixing unit 8, and the developer image is thermally fixed on the sheet. Incidentally, the registration roller 72 is one example of a conveying roller that adjusts a timing of conveying the sheet to the process unit 50.

The main unit 10 includes two sheet discharging paths downstream in the sheet conveying direction from the fixing unit 8. One is a sheet discharging path 82U having a substantially U-shape (one example of a first sheet discharging path) (hereinafter referred to as "U-turn path 82U"), in which the path passes through a conveying roller 75 and a discharge roller 76, reverses the traveling direction, and is introduced into the sheet discharge tray 92. In the image forming apparatus 100, inner side face of the cover 12 forms a part of the U-turn path 82U. Therefore, a sheet can be passed through the U-turn path 82U when the cover 12 is closed. The other is a sheet discharging path 82S having a substantially liner shape (one example of second sheet discharging path) (hereinafter referred to as "straight path 82S"), in which the path passes through the conveying roller 75, does not to reverse the traveling direction, and is introduced into the opened cover 12 when the cover 12 is opened. In the straight path 82S, the cover 12 also functions as a sheet discharge tray. The sheet can be passed through the straight path 82S when the cover 12 is open.

That is, in the image forming apparatus 100 according to the exemplary embodiment, the U-turn path 82U is selected when the cover 12 is closed, and the straight path 82S is selected when the cover 12 is open. In the main unit 10, the sheet, on which the developer image is fixed, is discharged via either of the sheet discharging paths to outside of the main unit 10.

A plurality of sensors for detecting the passage of a sheet is placed in the main unit 10. That is, the image forming apparatus 100 includes: a sensor 61 (hereinafter referred to as "before-registration sensor 61", which is one example of a second sensor) positioned just after the feed roller 71 in the conveying direction of a sheet; a sensor 62 (hereinafter referred to as "after-registration sensor 62", which is one example of a sensor) positioned downstream the registration roller 72 and upstream from the process unit 50; a sensor 63 (hereinafter referred to as "before-branch sensor 63") positioned downstream from the fixing unit 8 and upstream from a branch point of the U-turn path 82U and the straight path 82S (in the exemplary embodiment, the conveying roller 75); and a sensor 64 (hereinafter referred to as "after-branch sensor 64") positioned downstream from the branch point and upstream from the discharge roller 76. The image forming apparatus 100 determines conveying timing of the sheet to the process unit 50 and detects a conveying failure of a jam, etc., based on a signal from each sensor.

The image forming apparatus 100 further includes a sensor 65 (hereinafter referred to as "cover sensor 65") for detecting the open/closed state of the cover 12. The image forming apparatus 100 determines the sheet discharging path based on a signal from the cover sensor 65. Incidentally, detailed configuration of each sensor will not be described here. A known device can be applied as each sensor.

In the sheet discharging paths, the minimum interval between rollers downstream from the conveying roller 75 and forming the U-turn path 82U is set to 150 mm, and the minimum interval between rollers forming the conveying path upstream from the conveying roller 75 is set to 100 mm, for example. Thus, the minimum sheet length of a sheet that can be conveyed on the U-turn path 82U (one example of a first dischargeable minimum sheet length) is 150 mm, and the minimum sheet length of a sheet that can be conveyed on the straight path 82S (one example of a second dischargeable minimum sheet length) is 100 mm.

(Electric Configuration of Image Forming Apparatus)

Figure 4:
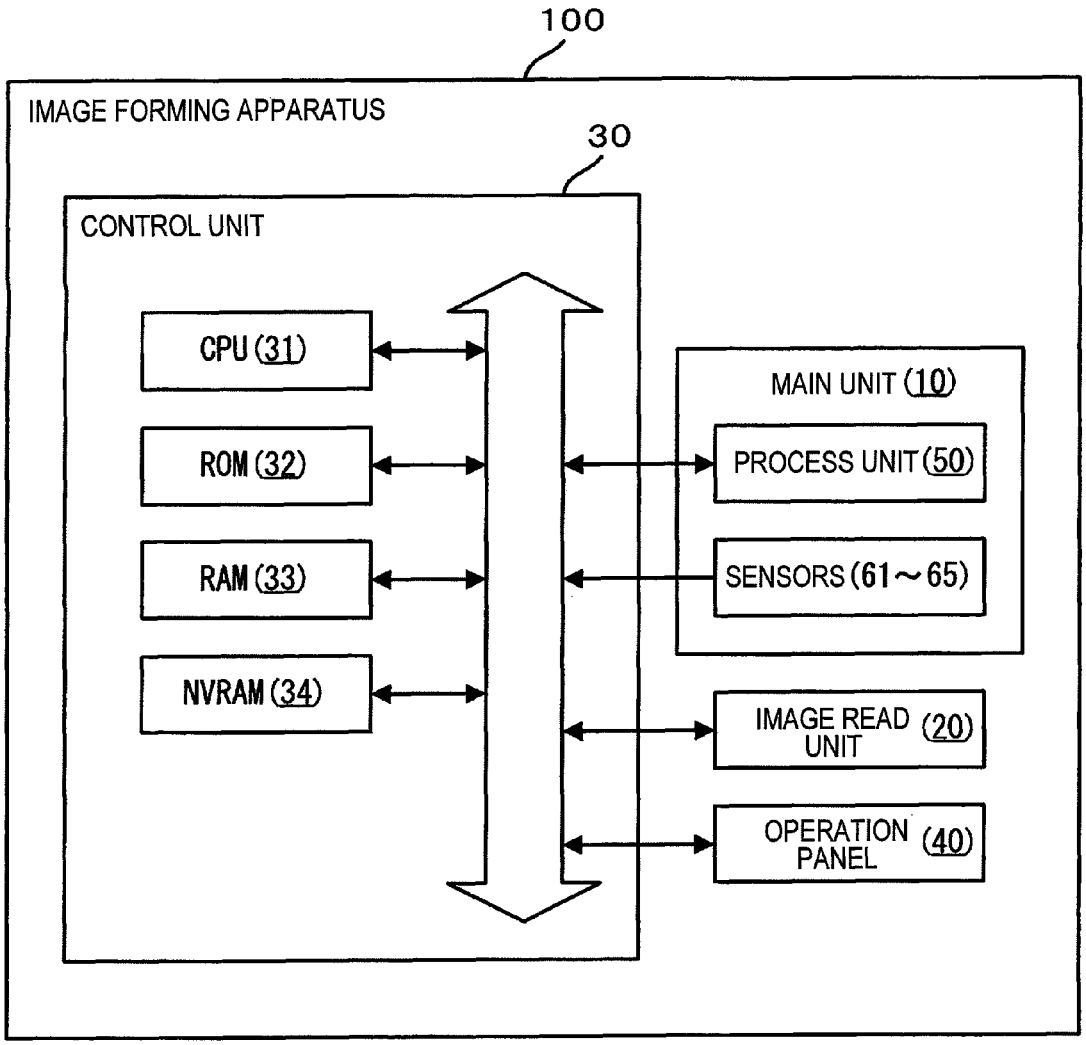
FIG. 4 is a block diagram showing electric configuration of the image forming apparatus.

An electric configuration of the image forming apparatus 100 will be described. As shown in FIG. 4, the image forming apparatus 100 includes a control unit 30 (one example of a control unit, a measuring unit and a second measuring unit) including a CPU 31, ROM 32, RAM 33, and NVRAM (non-volatile RAM) 34. The control unit 30 is electrically connected to the main unit 10, the image read unit 20, the operation panel 40, etc.

The ROM 32 stores various control programs, various settings, initial values, etc., for controlling the image forming apparatus 100. The RAM 33 is used as a work area, into which the control programs are read, or a storage area for temporarily storing image data.

The CPU 31 controls components of the image forming apparatus 100 (for example, the lighting timing of the exposure unit 3, drive motors (not shown) of the rollers forming the sheet feeding path 81U and the sheet discharging paths 82U and 82S, and a moving motor (not shown) of an image sensor unit implementing the image read unit 20) while storing processing result thereof in the RAM 33 or the NVRAM 34 in accordance with the control program read from the ROM 32 and the signals sent from the various sensors.

(Detection Process of Sheet Remaining Undelivered)

Subsequently, a detection process of a sheet remaining undelivered will be described. A sheet remaining undelivered is detected based on the timing at which the sheet arrives at each sensor (detection timing of the leading end of the sheet) and the timing at which the sheet passes through each sensor (detection timing of the trailing end of the sheet).

Figure 5:
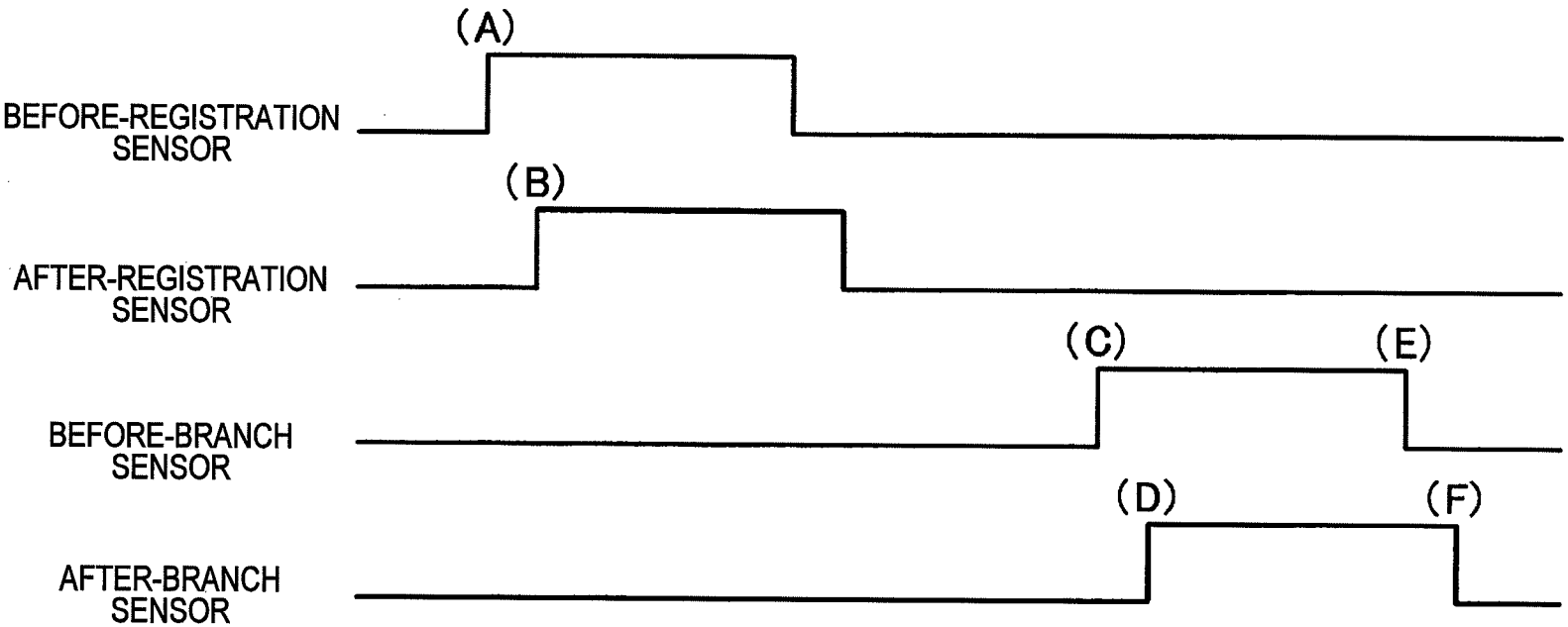
FIG. 5 is a timing chart showing an output operation flow of sensors.

FIG. 5 shows an example of the output signals of the sensors when a sheet is conveyed on the sheet discharging path 82U and is normally conveyed. First, when a sheet is delivered from the sheet feed cassette 91, initially the before-registration sensor 61 detects arrival of the sheet (A) and outputs high (ON). Then, when the leading end of the sheet passes through the registration roller 72, the after-registration sensor 62 detects arrival of the sheet and is turned ON (B). Then, the sheet is conveyed to the process unit 50 and the trailing end of the sheet passes through the before-registration sensor 61, whereby the before-registration sensor 61 outputs low (OFF). The trailing end of the sheet passes through the after-registration sensor 62, the after-registration sensor 62 is turned OFF.

As the leading end of the sheet passes through the process unit 50 and the fixing unit 8, the before-branch sensor 63 detects arrival of the sheet (C) and is turned ON. Then, when the leading end of the sheet passes through the conveying roller 75, the after-branch sensor 64 detects arrival of the sheet (D) and is turned ON. Then, the sheet is delivered from the trailing end from the fixing unit 8 and the trailing end of the sheet passes through the before-branch sensor 63, whereby the before-branch sensor 63 is turned OFF (E). The trailing end of the sheet passes through the after-branch sensor 64, the after-branch sensor 64 is turned OFF (F).

In the operation, for example, if the before-branch sensor 63 is not turned ON within a predetermined time since the point in time at which the after-registration sensor 62 was turned ON (B), it is determined that a jam occurs between the after-registration sensor 62 and the before-branch sensor 63. For example, if the sheet remains undelivered in the U-turn path, after the after-branch sensor 64 is turned ON ((D) in FIG. 5), the sensor is not turned OFF although a predetermined time has elapsed. In such a case, it can be determined that an event of the sheet remaining undelivered has occurred.

(Sheet Leading End Position Management Process)

A detection process of a sheet remaining undelivered will be described. To begin with, position management process in detection of the leading end of a sheet (one example of a control unit) will be described with reference to a flowchart of FIG. 6. This process is started when carrying of a sheet into the apparatus by the feed roller 71 is started.

First, it is determined whether the before-registration sensor 61 is turned ON (S101). If the before-registration sensor 61 is not turned ON (NO at S101), the image forming apparatus 100 waits until the before-registration sensor 61 is turned ON. If the before-registration sensor 61 is not turned ON although a predetermined time has elapsed since the process started, a jam is determined and the process is terminated.

Figure 7:
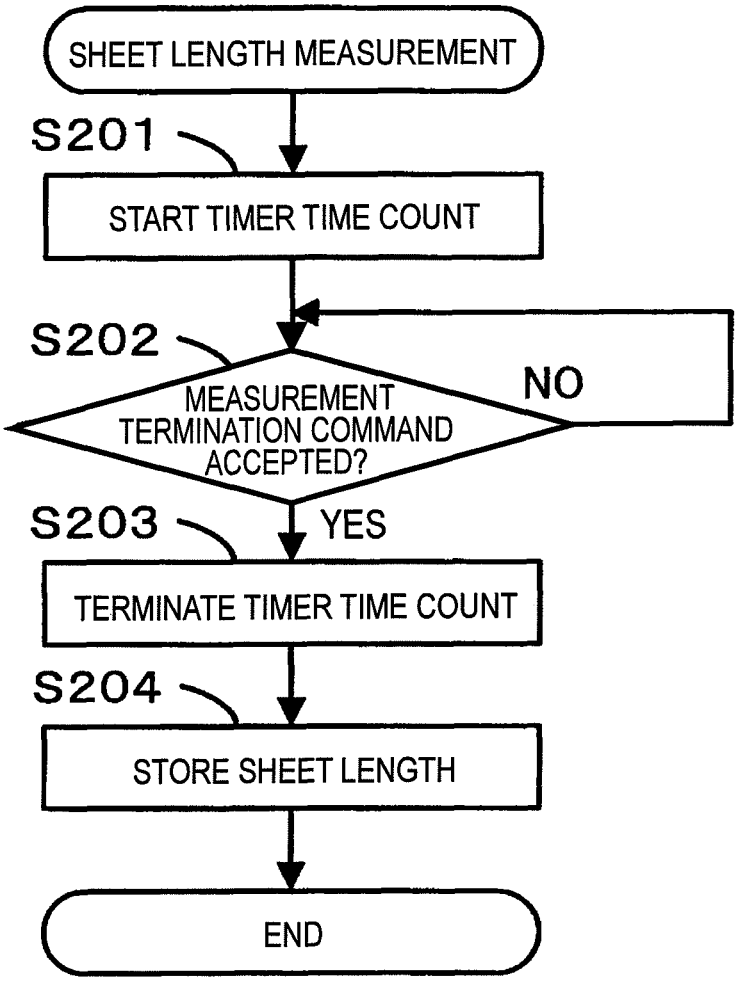
FIG. 7 is a flowchart showing a sheet length measurement process.

If the before-registration sensor 61 is turned ON within the predetermined time (YES at S101), sheet length measurement of the sheet is started (S102: An example of second measurement unit). The sheet length measurement is performed according to a flowchart shown in FIG. 7.

Referring again to FIG. 6, if the after-registration sensor 62 is turned ON within a predetermined time (YES at S101), sheet length measurement is started (S102). The sheet length is measured according to a process shown in a flowchart of FIG. 9.

Referring again to FIG. 6, after the sheet length measurement is started, it is determined whether the after-registration sensor 62 is turned ON (S103). If the after-registration sensor 62 is not turned ON (NO at S103), the image forming apparatus 100 waits until the after-registration sensor 62 is turned ON. If the after-registration sensor 62 is not turned ON although a predetermined time has elapsed since the point in time at which the before-registration sensor 61 was turned ON ((A) in FIG. 5), a jam is determined and the process is terminated.

If the after-registration sensor 62 is turned ON within the predetermined time (YES at S103), again sheet length measurement of the sheet is started (S104: An example of measurement unit). The process of the sheet length measurement process is similar to that of the process at step S102, but the processes differ in sheet length measurement start trigger (turning ON of the before-registration sensor 61, turning ON of the after-registration sensor 62). S102 and S104 are similar process, but operate independently of each other and output individual measurement results. In the description to follow, the sheet length measurement at S102 is "first sheet length measurement", and the sheet length measurement at S104 is "second sheet length measurement."

The after-registration sensor 62 is also used for start timing control of image formation of the process unit 50. Thus, the image forming position on a sheet needs to be highly accurate and a highly accurate sensor is used for the after-registration sensor 62 as compared with the before-registration sensor 61. Then, in the first sheet length measurement, a rough sheet length is acquired and a sheet suspected of a cause for remaining undelivered is early detected using a threshold value larger than the minimum sheet length. In the second sheet length measurement, it is precisely determined whether the sheet can be conveyed using a threshold value equal to the minimum sheet length (described later).

Next, the image forming apparatus 100 waits until the leading end of the sheet reaches the position just before entering the fixing unit 8 (S105). Specifically, in the exemplary embodiment, the assumed required time until the leading end of the sheet reaches the position just before the fixing unit 8 (for example, the position 5 mm ahead of the fixing unit 8) after passing through the after-registration sensor 62 is set, and it is determined whether the leading end of the sheet has reached the position just before the fixing unit 8 according to whether the assumed required time has elapsed since the point in time at which the after-registration sensor 62 was turned ON ((B) in FIG. 5). A sensor may be placed between the process unit 50 and the fixing unit 8 for determining arrival of the sheet based on the signal of the sensor.

If the leading end of the sheet reaches the position just before entering the fixing unit 8 (YES at S105), it is determined whether a remaining-undelivered flag is ON (S106). In the image forming apparatus 100 of the exemplary embodiment, if a sheet remains undelivered in the U-turn path 82U, the remaining-undelivered flag is set to ON. Then, if the remaining-undelivered flag is OFF (NO at S106), the process is terminated. The timing of setting the remaining-undelivered flag to ON is described later.

In contrast, if the remaining-undelivered flag is ON (YES at S106), the sheet conveying operation is stopped (S181) and the process is terminated. Emergency stop of all operation is not required in stop process in a sheet remaining undelivered unlike stop process in a jam. For example, cleaning process after image formation, etc., may be continued.

Figure 6:
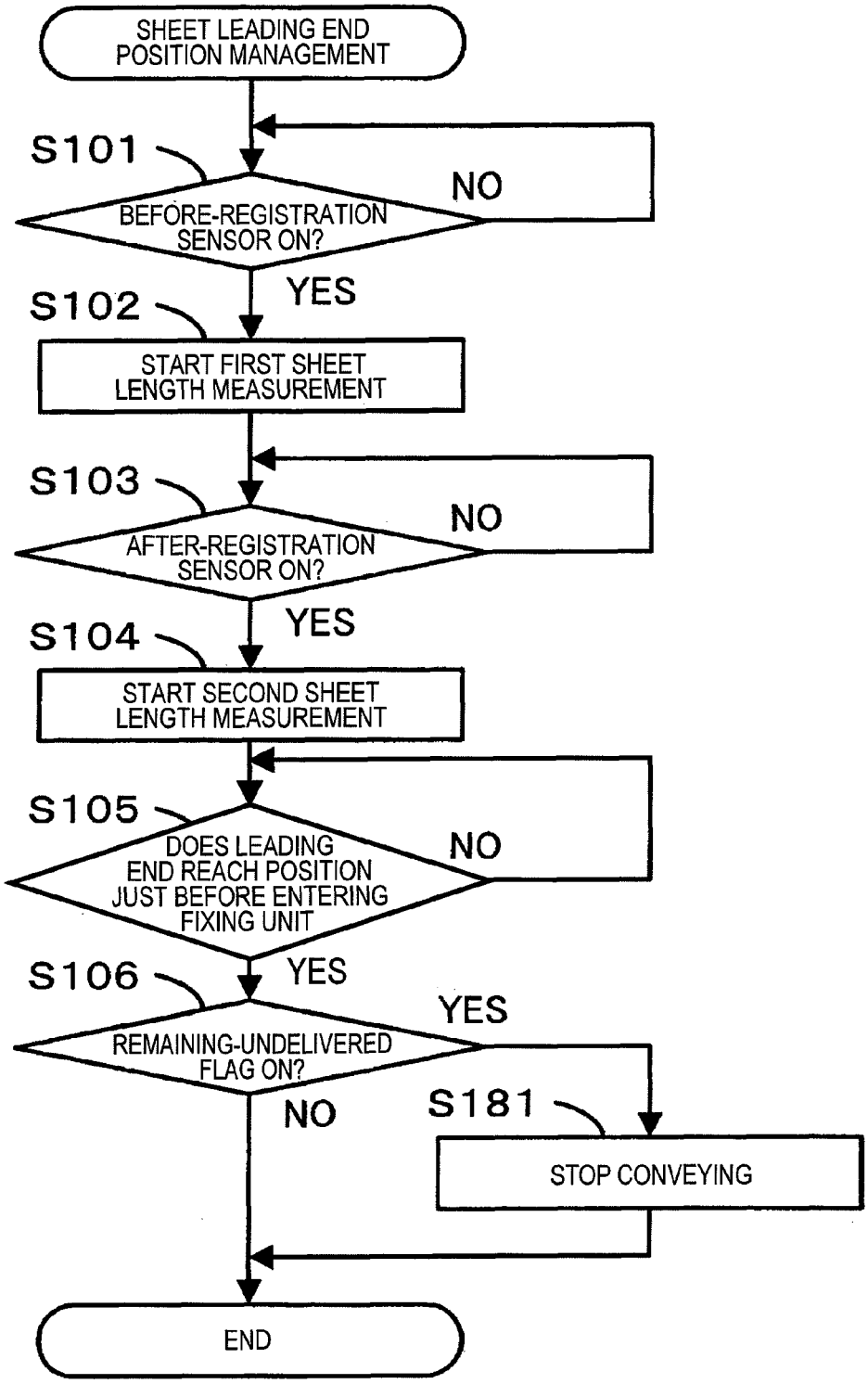
FIG. 6 is a flowchart showing a position management process of a leading end of a sheet.

In the stop process executed because of a sheet remaining undelivered in FIG. 6, process after the leading end of the sheet passes through the fixing unit 8, namely, determination as to whether the before-branch sensor 63 is ON and determination whether the after-branch sensor 64 is ON are omitted. In fact, after the process of S106, it is determined whether the leading end of the sheet arrives at each sensor in the order of the before-branch sensor 630N and the after-branch sensor 64 ON.

(Sheet Trailing End Position Management Process)

Subsequently, position management process in detection of the trailing end of a sheet (one example of a control unit) will be described with reference to flowcharts of FIGS. 8 and 9. This process is started when the before-registration sensor 61 is turned ON.

Figure 8:
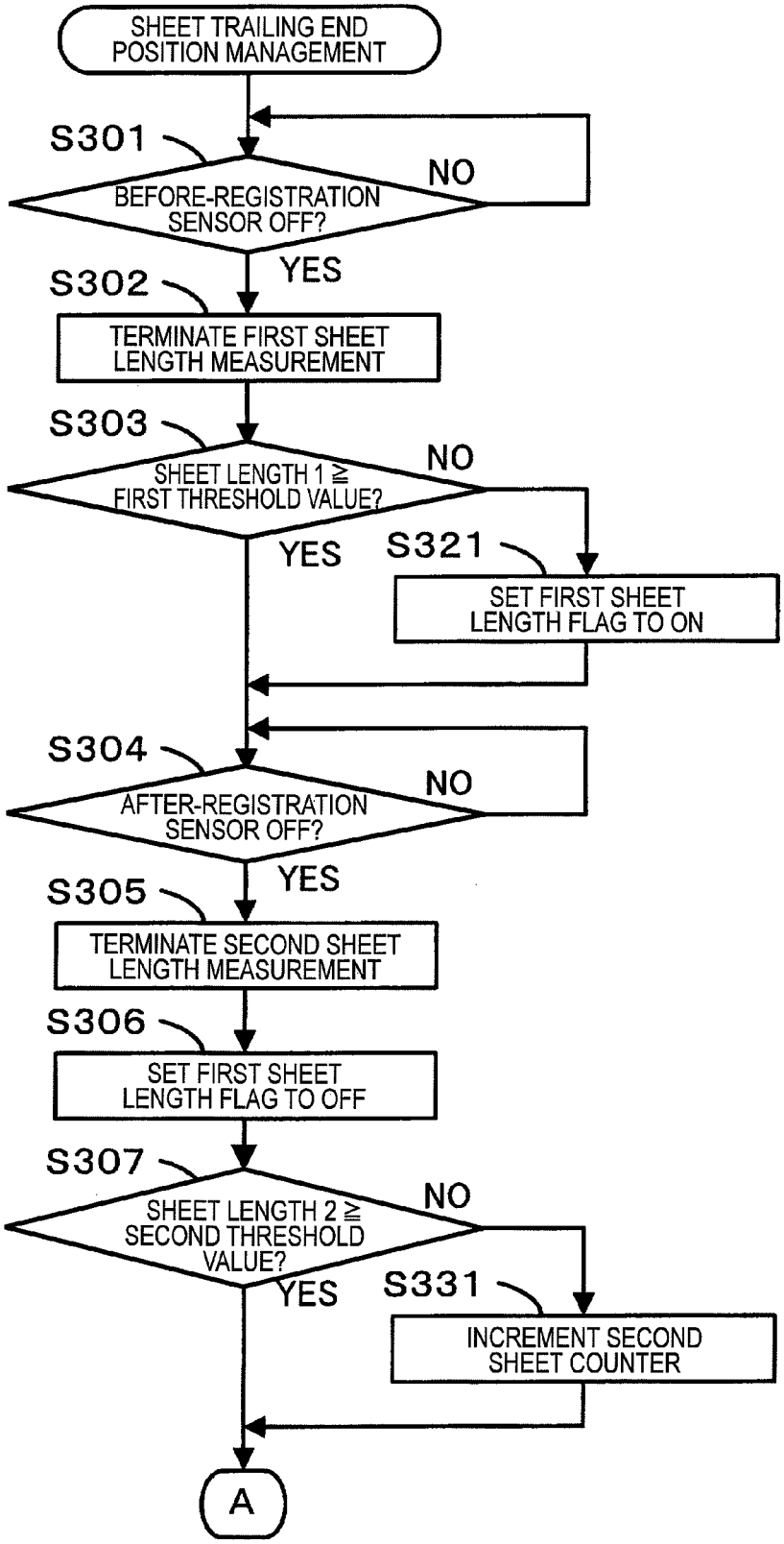
FIG. 8 is a flowchart showing a position management process of a trailing end of a sheet.

First, as shown in FIG. 8, it is determined whether the before-registration sensor 61 is turned OFF (S301). If the before-registration sensor 61 is not turned OFF (NO at S301), the image forming apparatus 100 waits until the before-registration sensor 61 is turned OFF. If the before-registration sensor 61 is not turned OFF although a predetermined time has elapsed since the point in time at which the before-registration sensor 61 was turned ON ((A) in FIG. 5), a jam is determined and the process is terminated.

If the before-registration sensor 61 is turned OFF within the predetermined time (YES at S301), a termination command of the first sheet length measurement started at S102 is given (S302). Accordingly, the sheet length of the sheet passing through the before-registration sensor 61 is obtained. The measurement result of the first sheet length measurement is "sheet length 1."

Next, it is determined whether the sheet length 1 is equal to or more than a first threshold value previously defined as the minimum sheet length that can be supported in the U-turn path 82 (S303). The first threshold value is set to a slightly larger value (for example, 170 mm) than the actual minimum sheet length (in the exemplary embodiment, 150 mm). Accordingly, a sheet having a high possibility that it will remain undelivered is detected. If the sheet length 1 is less than the first threshold value (NO at S303), a first sheet length flag is set to ON (S321) and the process goes to S304.

If the sheet length 1 is equal to or more than the first threshold value (YES at S303), it is determined whether the after-registration sensor 62 is turned OFF (S304).

If the after-registration sensor 62 is not turned OFF (NO at S304), the image forming apparatus 100 waits until the after-registration sensor 62 is turned OFF. If the after-registration sensor 62 is not turned OFF although a predetermined time has elapsed since the point in time at which the after-registration sensor 62 was turned OFF ((B) in FIG. 5), a jam is determined and the process is terminated.

If the after-registration sensor 62 is turned OFF within the predetermined time (YES at S304), a termination command of the second sheet length measurement started at S104 is given (S305). Accordingly, the sheet length of the sheet passing through the after-registration sensor 62 is obtained. The measurement result of the second sheet length measurement is "sheet length 2." Then, the first sheet length flag is set to OFF (S306).

Next, it is determined whether the sheet length 2 is equal to or more than a second threshold value previously defined as the minimum sheet length that can be supported in the U-turn path 82 (S307). The second threshold value is set to a value smaller than the first threshold value and equal to the actual minimum sheet length (in the exemplary embodiment, 150 mm). Accordingly, a possibility that the sheet will remain undelivered is determined in detail. If the sheet length 2 is less than the second threshold value (NO at S307), a second sheet counter is incremented (S331) and the routine makes a transition to the flowchart of FIG. 9.

Figure 9:
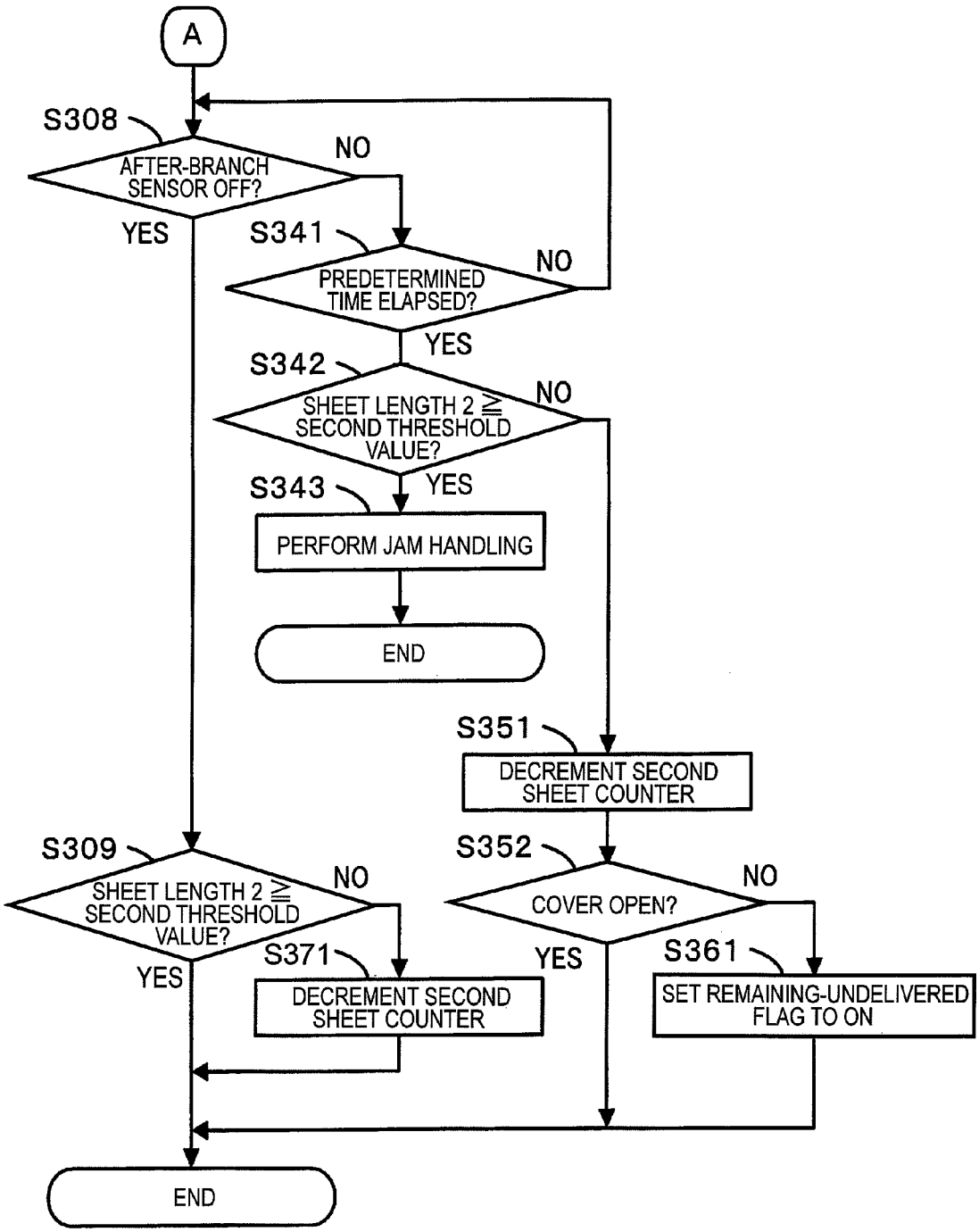
FIG. 9 is a flowchart showing the position management process of the trailing end of the sheet continued from FIG. 8.

If the sheet length 2 is equal to or more than the second threshold value (YES at S307), the routine makes a transition to the flowchart of FIG. 9, and it is determined whether the sheet turns OFF the after-branch sensor 64 (S308). If the after-branch sensor 64 is not turned OFF (NO at S308), it is determined whether the count time since the point in time at which the after-branch sensor 64 was turned ON ((D) in FIG. 5) exceeds a predetermined time (S341). That is, it is determined whether the time during which the sheet is detected by the after-branch sensor 64 (between (D) and (F) in FIG. 5) is within an allowable range. If the time does not exceed the predetermined time (NO at S341), the process returns to S308.

If the time exceeds the predetermined time (YES at S341), it is determined whether the sheet length 2 is equal to or more than the second threshold value (S342). If the sheet length 2 is equal to or more than the second threshold value (YES at S342), the sheet is of a conveyable size. Thus, a jam is determined and jam handling is performed (S342). Specifically, in the jam handling, the user is notified that a jam has occurred. Accordingly, the user can recognize the jam. Further, the sheet conveying operation and the image forming operation of the process unit 50 are stopped.

If the sheet length 2 is less than the second threshold value (NO at S342), the second sheet counter is decremented (S351), and it is determined whether the cover 12 is open (S352). The open or closed state of the cover 12 is determined based on the output of the cover sensor 65.

If the cover 12 is closed, namely, if the U-turn path 82U is selected (NO at S352), it is determined that the sheet remains undelivered. Then, the remaining-undelivered flag is set to ON (S361) and the process is terminated. In contrast, if the cover 12 is open, namely, if the straight path 82S is selected (YES at S352), the routine is terminated. That is, if the cover 12 is open, there is a possibility that the user may touch the detection area of the after-branch sensor 64. Thus, it is considered that the user continues to turn ON the after-branch sensor 64. Then, if the cover 12 is open, the routine is terminated without setting the remaining-undelivered flag to ON.

In contrast, if the after-branch sensor 64 is turned OFF (YES at S308), it can be determined that the sheet is discharged to the sheet discharge tray 92 or the cover 12. Then, it is determined whether the sheet length 2 is equal to or more than the second threshold value (S309). If the sheet length 2 is equal to or more than the second threshold value (YES at S342), the process is terminated. If the sheet length 2 is less than the second threshold value (NO at S342), the second sheet counter is decremented (S371). That is, when the cover 12 is open if the sheet length is short or when the sheet can be conveyed even when the cover 12 is closed, the after-branch sensor 64 is turned OFF. Thus, the value of the second sheet counter is decremented and the process is terminated.

That is, in the image forming apparatus 100 of the exemplary embodiment, a sheet shorter than the minimum sheet length supported in the U-turn path 82U is detected in the position management process of the trailing end of a sheet. If such a sheet is detected when the U-turn path 82U is selected, the remaining-undelivered flag is set to ON. At this time, the detected sheet passes through the fixing unit 8 and is conveyed to the U-turn path 82U and remains undelivered therein in a printed state. In the image forming apparatus 100, in the position management process of the leading end of a sheet, if the remaining-undelivered flag is ON, the subsequent sheet is stopped just before the fixing unit 8. This means that the sheet subsequent to the sheet conveyed to and remaining undelivered in the U-turn path 82U stops before arriving at the position of the sheet remaining undelivered. Accordingly, a jam of the subsequent sheet caused by the sheet remaining undelivered can be avoided.

In the image forming apparatus 100, the subsequent sheet is stopped in front of the fixing unit 8. If the subsequent sheet is stopped in the fixing unit 8, sheet removing work in the fixing unit 8 results in contamination of the fixing unit 8 caused by unfixed developer and a sheet conveyed after the sheet removing work may be made dirty. To take out the sheet from the fixing unit 8, the user may be forced to execute a complicated work procedure. It can be expected that the problems will be circumvented by stopping the subsequent sheet before the sheet arrives at the fixing unit 8.

(Sheet Feed Permission Determination Process)

Figure 10:
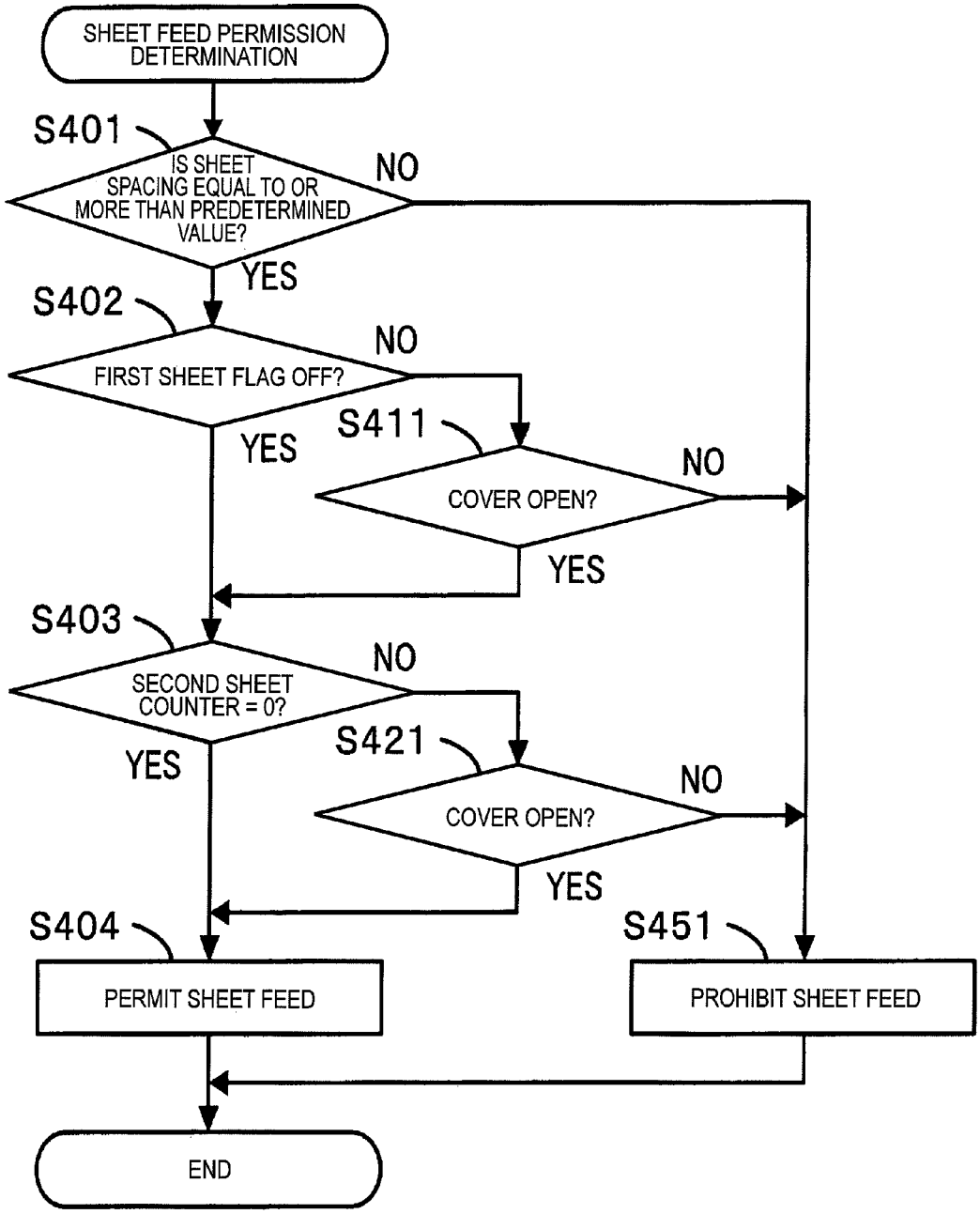
FIG. 10 is a flowchart showing a sheet feed permission determination process.

Subsequently, sheet feed permission determination process of determining whether or not to feed a sheet (one example of a control unit) will be described with reference to a flowchart of FIG. 10. This process is executed at regular time intervals after a sheet feed start instruction is received.

First, it is determined whether the sheet spacing from the preceding sheet is equal to or more than a predetermined value (S401). Specifically, the OFF continuation time period of the before-registration sensor 61 is counted with a timer, and it is determined whether the sheet spacing is equal to or more than the predetermined value depending on whether the count time is equal to or more than a predetermined value. If the sheet spacing is less than the predetermined value (NO at S401), sheet feed is prohibited (S451) and the process is terminated.

If the sheet spacing is equal to or more than the predetermined value (YES at S401), it is determined whether the first sheet flag is OFF (S402). If the first sheet flag is ON (NO at S402), it is determined whether the cover 12 is open (S411). If the cover is closed (NO at S411), there is a possibility that the sheet will remain undelivered in the U-turn path 82U. Then, sheet feed is prohibited (S451). In contrast, if the cover 12 is open is determined (YES at S411), the straight path 82S is used and thus the sheet will not remain undelivered. Then, the process goes to S403.

If the first sheet flag is OFF (YES at S402), it is determined whether the second sheet counter is zero (S403). If the second sheet counter is not zero (NO at S403), it is determined whether the cover 12 is open (S421). If the cover is closed (NO at S421), there is a possibility that the sheet will remain undelivered in the U-turn path 82U. Then, sheet feed is prohibited (S451). In contrast, if the cover 12 is open is determined (YES at S421), the straight path 82S is used and thus the sheet will not remain undelivered. Then, the process goes to S404.

If the second sheet counter is zero (YES at S403), no sheet remains undelivered. Then, sheet feed is permitted (S404) and the process is terminated. A sheet is carried into the image forming apparatus 100 while sheet feed is permitted; the image forming apparatus 100 waits for sheet feed while sheet feed is prohibited.

In the process, if it is determined that a sheet of a sheet length than the minimum sheet length in the U-turn path 82 has been conveyed as a result of the sheet length measurement of the first sheet length measurement and the second sheet length measurement and further if the cover 12 is closed, feed of the subsequent sheet is prohibited. Accordingly, stop of a large number of sheets in the conveying path is suppressed.

That is, in the process, sheet feed is determined according to the state of the first sheet length flag. The first sheet length flag indicates the determination result of a comparison between the sheet length 1 obtained from the output signal of the before-registration sensor 61 and the first threshold value of the minimum sheet length in the U-turn path 82; once the first sheet length flag is set to ON, it is not set to OFF until the leading end of the sheet passes through the after-registration sensor 62. That is, when the first sheet length flag is set to ON, the subsequent sheet is made to wait until at least completion of the second sheet length measurement of the after-registration sensor 62. Accordingly, stop of a plurality of sheets in the conveying path can be prevented.

In the process, sheet feed is also determined by the value of the second sheet counter. That is, since the accuracy of the before-registration sensor 61 is lower than that of the after-registration sensor 62, it may be determined that a sheet cannot be conveyed even if the size of the sheet is essentially dischargeable. In this case, if sheet feed is prohibited according to the state of the first sheet length flag (even if the determination at S303 is NO), sheet feed may be permitted depending on the value of the second sheet counter. Then, in the exemplary embodiment, the first sheet length flag is set to OFF (S306) before the determination of the sheet length 2. Whether or not to permit sheet discharge can be precisely determined by again determining sheet feed permission according to the value of the second sheet counter (S403) in a state in which the first sheet length flag is OFF. If the sheet can be discharged (YES at S403), sheet feed is again permitted, and the conveyance of the sheet can be performed more precisely.

(Cover Open Request Display Process)

Figure 11:
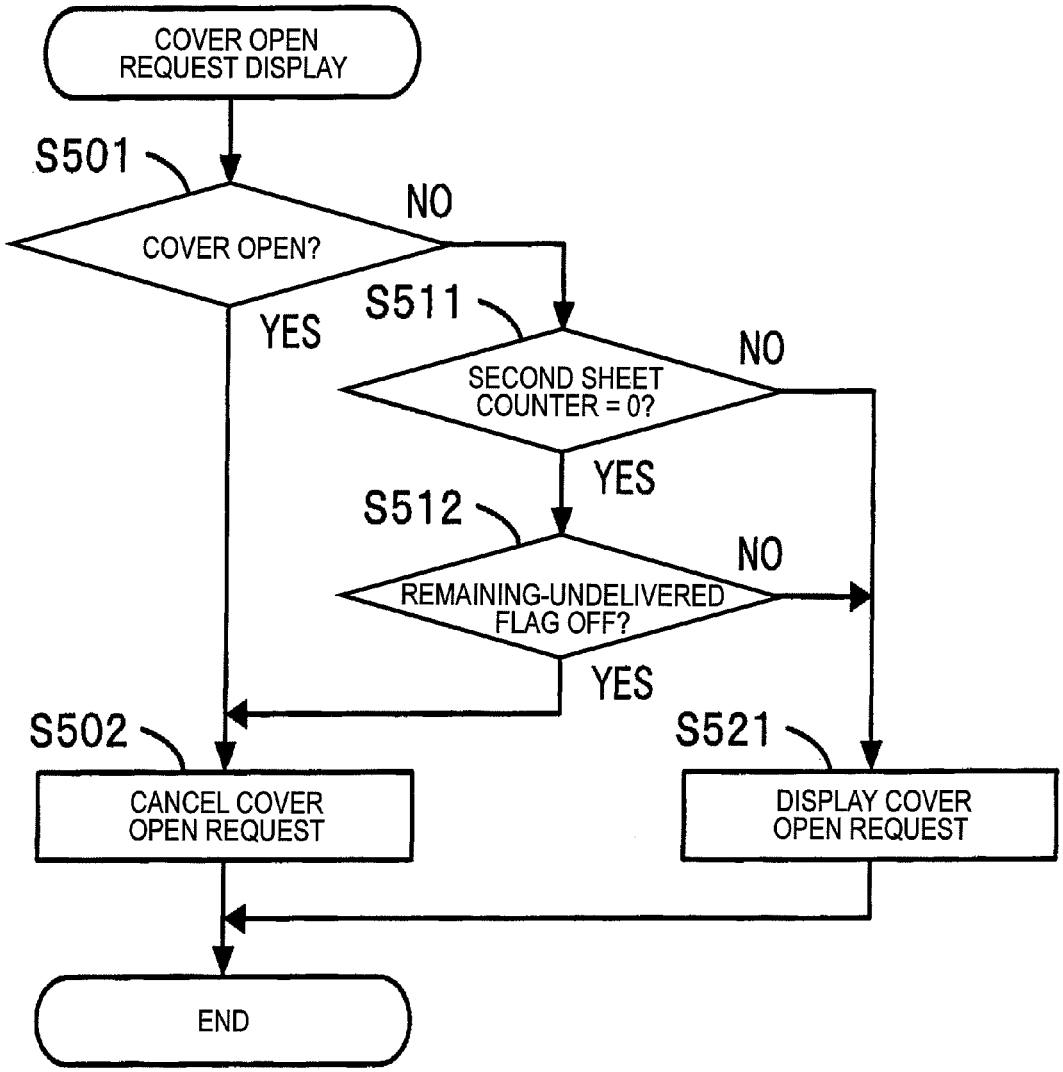
FIG. 11 is a flowchart showing a cover open request display process.

Subsequently, cover open request display process of determining whether or not to display an open command of the cover 12 (one example of a notification unit) will be described with reference to a flowchart of FIG. 11. This process is executed at regular time intervals after a sheet feed start instruction is received.

First, it is determined whether the cover 12 is open (S501). If the cover 12 is open (YES at S501), an open command of the cover 12 need not be displayed. Thus, cover open request display is canceled (S502) and the process is terminated.

In contrast, if the cover 12 is closed (NO at S501), it is determined whether the second sheet counter is zero (S511). If the second sheet counter is not zero (NO at S511), a sheet of a sheet length that cannot be conveyed on the U-turn path 82U is conveyed and the probability that the sheet will remain undelivered is extremely high and thus an open request of the cover 12 is displayed (S521). In the exemplary embodiment, for example, a message as shown in FIG. 12 is displayed on the display unit 41. This message display enables the user to recognize the sheet remaining undelivered. If the user opens the cover 12, the sheet remaining undelivered drops onto the cover 12 accordingly and automatically the remaining-undelivered state of the sheet is eliminated. In addition to the message display, a voice message, a warning beep, etc., may be produced. Upon detection of the cover 12 being open, the image forming apparatus 100 automatically restarts conveyance of the sheet.

If the second sheet counter is zero (YES at S511), it is determined whether the remaining-undelivered flag is OFF (S512). If the remaining-undelivered flag is ON (NO at S512), the sheet remains undelivered and thus a cover open request is displayed (S521). If the remaining-undelivered flag is OFF (YES at S512), it can be determined that no sheet remains undelivered. Thus, the process goes to S502 and cover open request display is canceled.

In the cover open request display process, the value of the first sheet flag is not referenced. That is, the first sheet flag is uncertain data involving a possibility that the determination may be overturned in the second sheet length measurement as described above. Thus, if the first sheet flag is referenced and a cover open request is displayed, the display may be canceled just after the display is produced. The user is confused from such display and thus display determination of a cover open request based on the first sheet flag is not made.

As described above in detail, in the image forming apparatus 100 of the exemplary embodiment, the minimum sheet length of a sheet that can be discharged on the U-turn path 82U is longer than that on the straight path 82S. If a sheet having a possibility that it will remain undelivered in the U-turn path 82U is conveyed, the sheet is conveyed downstream from the fixing unit 8. Consequently, the sheet remains undelivered in the U-turn path 82U downstream from the fixing unit 8 in a printed state. In contrast, the sheet subsequent to that sheet is stopped just before the fixing unit 8 upstream from the sheet. Accordingly, a serious jam that can occur as the sheet remaining undelivered and the subsequent sheet comes in contact with each other can be avoided. Damage caused as the sheet remaining undelivered comes in contact with the subsequent sheet can be avoided.

Further, a sheet U is longer than that on the straight path 82S. If a sheet having a possibility that it will remain undelivered in the U-turn path 82U is made to stay downstream from the fixing unit 8 without being stopped in the process unit 50 or the fixing unit 8. That is, the sheet can be taken out in a good sheet state and in a state in which an image is formed. Print of the sheet remaining undelivered is normally complete and after the cover 12 is opened, the print is restarted at the subsequent image. This means that the job can be completed early as compared with the manner in which print is restarted after the image printed on the sheet remaining undelivered is again formed from the beginning.

The above-described exemplary embodiment is not limited. Various modifications can be applied to the invention without departing from the scope of the invention. For example, the invention can be applied not only to a printer, but also to a device including an image forming function, such as a copier, a multifunction device, or a facsimile machine. The image forming system of the main unit 10 is not limited to electrophotography and may be ink jet. The image forming function or system may be able to form a color image or may form only a monochrome image.

In the above-described exemplary embodiments, the U-turn path 82U and the straight path 82S form two paths different in supported minimum sheet length. However, the invention is not limited thereto. For example, the invention can also be applied to a structure in which a plurality of sheet discharge trays different in placement in the height direction are included and the supported minimum sheet length varies from one sheet discharge path to one sheet discharge tray to another.

What is claimed is:

1. An image forming apparatus comprising:

an image forming unit that forms an image on a sheet;

a first sheet discharging path, which discharges a sheet passed through the image forming unit, and which has a first dischargeable minimum sheet length;

a second sheet discharging path, which discharges the sheet passed through the image forming unit, and which has a second dischargeable minimum sheet length, the second dischargeable minimum sheet length being shorter than the first dischargeable minimum sheet length;

a measuring unit that measures a length of the sheet conveyed to the image forming unit;

a control unit, a conveying roller that adjusts a timing of conveying the sheet to the image forming unit;

a sensor, which detects a passage of the sheet, and which is positioned upstream in the sheet conveying direction from the image forming unit and downstream from the conveying roller, a feed roller that feeds the sheet;

a second sensor, which detects the passage of the sheet, and which is positioned upstream in the sheet conveying direction from the conveying roller and downstream from the feed roller; and a second measuring unit that measures the sheet length using the second sensor, wherein the measuring unit measures the length of the sheet based on a detection result of the sensor, wherein, when the length of the sheet measured by the measuring unit is shorter than the first dischargeable minimum sheet length in a state in which the first sheet discharging path is selected, the control unit is configured to:

control the image forming unit to form the image on the measured sheet;

convey the measured sheet downstream in a sheet conveying direction from the image forming unit; and stop conveyance of a sheet subsequent to the measured sheet at a position upstream in the sheet conveying direction from the measured sheet, and wherein, when the length of the sheet measured by the second measuring unit is shorter than the first dischargeable minimum sheet length, the control unit suspends the conveyance of the subsequent sheet at least until the measuring unit completes the measurement of the sheet.

2. The image forming apparatus according to claim 1, wherein the second sensor is positioned upstream in the sheet conveying direction from the sensor.

3. The image forming apparatus according to claim 1, wherein, after the conveyance of the subsequent sheet is suspended as a result of the measurement by the second measuring unit, the control unit restarts the conveyance of the subsequent sheet when the length of the sheet is longer than the first dischargeable minimum sheet length as a result of the measurement by the measuring unit.

4. An image forming apparatus comprising:

an image forming unit that forms an image on a sheet;

a fixing unit that fixes the image formed on the sheet to the sheet;

a belt unit that conveys the sheet along the image forming unit to the fixing unit in a sheet conveying direction;

a first sheet discharging path, which discharges the sheet passed through the image forming unit, and which has a first dischargeable minimum sheet length;

a second sheet discharging path, which discharges the sheet passed through the image forming unit, and which has a second dischargeable minimum sheet length, the second dischargeable minimum sheet length being shorter than the first dischargeable minimum sheet length;

a measuring unit that measures a length of the sheet conveyed to the image forming unit; and a control unit that is connected to the image forming unit, the fixing unit, the belt unit, the first sheet discharging path, the second sheet discharging path and a measuring unit;

a conveying roller that adjusts a timing of conveying the sheet to the image forming unit;

a first sensor, which detects a passage of the sheet, and which is positioned upstream in the sheet conveying direction from the image forming unit and downstream from the conveying roller, a feed roller that feeds the sheet;

a second sensor, which detects the passage of the sheet, and which is positioned upstream in the sheet conveying direction from the conveying roller and downstream from the feed roller; and a second measuring unit that measures the sheet length using the second sensor, wherein the measuring unit measures the length of the sheet based on a detection result of the first sensor, wherein, when the length of the sheet measured by the measuring unit is shorter than the first dischargeable minimum sheet length in a state in which the first sheet discharging path is selected, the control unit is configured to:

control the image forming unit to form the image on the measured sheet;

control the belt unit to convey the measured sheet downstream in the sheet conveying direction from the image forming unit; and control the belt unit to stop conveyance of a sheet subsequent to the measured sheet at a position upstream in the sheet conveying direction from the measured sheet, and wherein, when the length of the sheet measured by the second measuring unit is shorter than the first dischargeable minimum sheet length, the control unit controls the belt unit to suspend the conveyance of the subsequent sheet at least until the measuring unit completes the measurement of the sheet.

5. The image forming apparatus according to claim 4, wherein the second sensor is positioned upstream from the first sensor in the sheet conveying direction.

6. The image forming apparatus according to claim 4, wherein, after the conveyance of the subsequent sheet is suspended as a result of the measurement by the second measuring unit, the control unit restarts the conveyance of the subsequent sheet when the length of the sheet is longer than the first dischargeable minimum sheet length as a result of the measurement by the measuring unit.

* * * * *